US008047878B2

(12) United States Patent
Szini et al.

(10) Patent No.: US 8,047,878 B2
(45) Date of Patent: Nov. 1, 2011

(54) HYBRID CONNECTOR JACK FOR AN ELECTRONIC DEVICE

(75) Inventors: Istvan Szini, Grayslake, IL (US); Manjeet Bhalla, Gurnee, IL (US); John Mura, Lindenhurst, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 0 days.

(21) Appl. No.: 12/322,125

(22) Filed: Jan. 29, 2009

(65) Prior Publication Data

US 2010/0190382 A1 Jul. 29, 2010

(51) Int. Cl.
*H01R 24/04* (2006.01)

(52) U.S. Cl. ..... 439/668

(58) Field of Classification Search ..... 439/668, 439/502, 218, 63, 175
See application file for complete search history.

(56) References Cited

U.S. PATENT DOCUMENTS

| | | | | |
|---|---|---|---|---|
| 5,244,402 | A * | 9/1993 | Pasterchick et al. | 439/217 |
| 5,362,251 | A * | 11/1994 | Bielak | 439/394 |
| 5,395,264 | A * | 3/1995 | Keith | 439/502 |
| 6,053,744 | A * | 4/2000 | Gray et al. | 439/63 |
| 6,126,465 | A * | 10/2000 | Franks, Jr. | 439/218 |
| 6,149,469 | A * | 11/2000 | Kim | 439/668 |
| 6,644,993 | B2 * | 11/2003 | Victor | 439/175 |
| 7,373,681 | B2 * | 5/2008 | Elsener | 7/118 |
| 7,476,798 | B1 * | 1/2009 | Beller et al. | 84/743 |
| 2003/0119368 | A1 | 6/2003 | Li et al. | |
| 2004/0029449 | A1 * | 2/2004 | Liu | 439/668 |

FOREIGN PATENT DOCUMENTS

| | | | |
|---|---|---|---|
| KR | 2020000007090 | | 4/2000 |
| KR | 200394114 | Y1 | 8/2005 |
| KR | 100646826 | B1 | 11/2006 |

OTHER PUBLICATIONS

Woo, Marn Woong: The International Search Report and The Written Opinion of the International Searching Authority, Korean Intellectual Property Office, Daejeon, Republic of Korea, completed: Aug. 6, 2010, mailed: Aug. 6, 2010, all pages.

* cited by examiner

*Primary Examiner* — Jean Duverne

(57) ABSTRACT

A hybrid connector jack assembly for use in association with an electronic device comprising an audio jack component and a coaxial connector jack component. The audio jack component is coupled to an electronic circuit and has a proximal end and a distal end, an elongated opening extends from the proximal end to the distal end. It is structurally configured to receive a male audio connector. The coaxial connector jack component positioned at the distal end of the audio jack component and accessible through the elongated opening of the audio jack component. This allows for the insertion of a coaxial cable through the audio jack component and into operative engagement with the coaxial connector jack component.

7 Claims, 1 Drawing Sheet

HYBRID CONNECTOR JACK FOR AN ELECTRONIC DEVICE

BACKGROUND OF THE DISCLOSURE

1. Field of the Disclosure

The disclosure relates in general to connector jacks associated with electronic devices, and more particularly, to a hybrid connector jack for an electronic device. The hybrid connector jack is configured for receipt of a coaxial connector or an audio connector (such as a tip, ring, sleeve connector) through the same opening.

2. Background Art

Electronic devices increasingly allow for the use of an outside audio source or an outside audio speaker. Such devices include mobile phones which are configured with a conventional audio jack of the type that accommodates common audio connectors which are commonly referred to as a tip, ring, sleeve connector or configuration (differing types include, but are not limited to TRS, TS and TRRS connectors) in a 2.5 mm or 3.5 mm size. While other connectors are available, these tend to be the most commonly utilized connectors for audio transmission between the mobile device and an outside speaker and/or microphone.

Additionally, many devices have a coaxial connector jack typically spaced apart from the audio jack and configured for the attachment of a coaxial connection. For mobile phones, such a coaxial connection comprises an RF connection that is commonly utilized, for example, for an outside antenna. These coaxial connector jacks are often found on the back of a mobile phone. As these coaxial connector jacks are exposed, when not in use, coaxial connector jacks are typically covered with a grommet or a plug.

Problematically, with electronic devices including greater features in ever smaller sizes, it has become difficult to provide enough space on the body of the electronic devices for an audio jack much less another jack, such as a coaxial connector jack. Thus, many electronic devices have removed the coaxial connector jack which lessens the versatility and applicability of a number of electronic devices.

Even when provided, additional parts are required for the requirement of a grommet or plug to cover the coaxial connector jack. Furthermore, additional assembly time is required to assemble the grommet or plug. Finally, due to the shallow nature of the coaxial connector jack, the plug is often lost, leaving the coaxial connector core or outer shield susceptible to damage.

SUMMARY OF THE DISCLOSURE

The disclosure is directed to a hybrid connector jack assembly which is configured for use in association with an electronic device. The hybrid connector jack assembly comprises an audio jack component and a coaxial connector jack component, to supply both type of connections while minimizing the space required on the body for the two types of connector jacks. The audio jack component is coupled to an electronic circuit. The audio jack component includes a proximal end and a distal end. An elongated opening extends from the proximal end to the distal end and the opening is structurally configured to receive a male audio connector. The coaxial connector jack component is positioned at the distal end of the audio jack component and accessible through the elongated opening of the audio jack component. Thus, the positioning of the coaxial connector jack component allows for the insertion of a coaxial cable through the audio jack component and into operative engagement with the coaxial connector jack component.

In an exemplary embodiment, the audio jack is one of the group consisting of: a TRS component, a TS component and a TRRS component.

In an exemplary embodiment, the audio jack comprises one of a 2.5 mm and a 3.5 mm jack.

In an exemplary embodiment, the coaxial connector jack component comprises an RF connector jack component which is configured for operative engagement with a coaxial cable coupled to one of the group consisting of: a GPS unit, an external antenna, an Active GPS antenna, an emergency antenna, a hands free car kit and a port for phasing a radio on the electronic device.

In an exemplary embodiment, the coaxial connector jack component includes a right angle adapter extending from the printed circuit board to an operable position at the distal end of the audio jack component.

In another aspect of the invention, the invention comprises an electronic device which includes a body and the hybrid connector jack assembly accessible through the body. The body includes a front, a back, a first side, a second side, a top and a bottom.

In an exemplary embodiment, the electronic device may comprise a mobile communication device. The hybrid connector jack assembly is accessible from one of the first side, the second side, the top and the bottom of the body. Additionally, the body further comprises a keypad and a display screen.

In an exemplary embodiment, the mobile communication device further includes a speaker and a microphone disposed on the body. Additionally, the hybrid connector jack assembly may be accessible from the top of the body.

In another aspect of the invention, the invention comprises a hybrid connector for use in association with a hybrid connector jack assembly. The connector includes an audio connector and a coaxial connector. The audio connector includes a sleeve and a tip extending outwardly from the sleeve at a distal end thereof, and being insulated therefrom. The coaxial connector emanates outwardly from a distal end of the tip of the audio connector and including a central core connector and an outer shield connector which are isolated from each other and both of which are isolated from the tip of the audio connector.

In an exemplary embodiment, the hybrid connector further includes a ring emanating outwardly from the sleeve and positioned between the sleeve and the tip and being isolated from each.

BRIEF DESCRIPTION OF THE DRAWINGS

The disclosure will now be described with reference to the drawings wherein.

DETAILED DESCRIPTION OF THE DISCLOSURE

Figure 1:
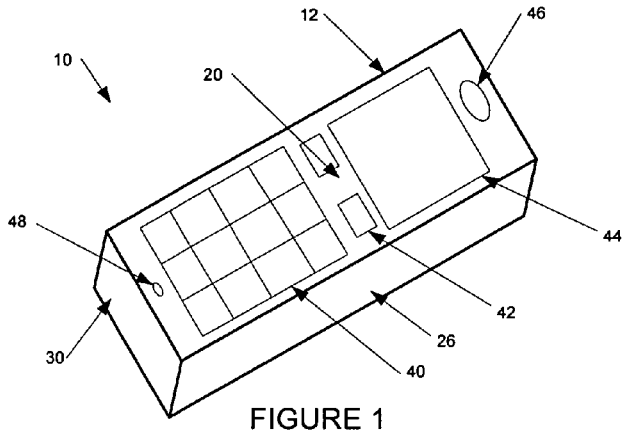
FIG. 1 of the drawings is a perspective view of an electronic device, and in the particular, a mobile telephone, utilizing the hybrid connector jack assembly of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, an electronic device 10 is shown. The electronic device 10, in the embodiment shown comprises a mobile telephone, although a number of different devices are contemplated, such as smartphones, PDA's, two way radios, communication devices, among others. Additionally, a number of different configurations for the mobile telephone are contemplated, including clamshell configurations, slider configurations, "candy bar" configurations, and flip configurations.

Figure 3:
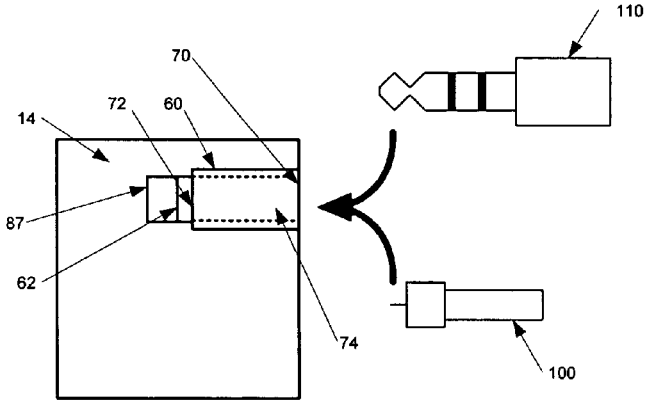
FIG. 3 of the drawings is a front elevational view of a printed circuit board (PCB) utilized within the electronic device shown in FIG. 1, showing, in particular, the audio jack component and the coaxial connector jack component of the hybrid connector jack assembly, and including a depiction of both a coaxial connector and an audio connector which are capable of interfacing with the hybrid connector jack assembly.

The electronic device 10 includes housing 12 (FIG. 1) and, among other internal features, a electrical circuit, contained on, for example, a flexible circuit, or a printed circuit board (a "PCB") 14 (FIG. 3). With reference to FIGS. 1 and/or 3, the housing 12 includes front 20, back 22, first side 24, second side 26, top 28 and bottom 30. Generally, the electronic device comprises some type of rectangular cubic configuration, while other configurations are likewise contemplated. The configuration of the presently shown device is merely for illustrative purposes and not to be deemed limiting. In certain embodiments, the housing may include two components which can move relative to each other. For example, a clamshell configuration allows for one housing component to rotate/pivot relative to a second housing component. In other embodiments, like the slider embodiment, one housing component slides relative to a second component. In still other embodiments, multiple modes of relative movement are contemplated, such that the one housing component can both slide and rotate/pivot relative to another housing component.

Figure 2:
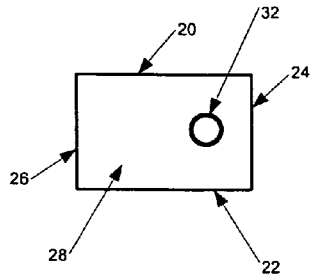
FIG. 2 of the drawings is a top plan view of the electronic device of FIG. 1 showing, in particular, the hybrid connector jack assembly of the present invention.

Referring again to FIG. 1, such electronic devices, in the case of a mobile telephone include a keypad 40, buttons 42, a screen 44, speaker 46 and microphone 48. These may be positioned on any of the surfaces. Typically, such electronic devices include an audio jack, and in the present invention, with reference to FIG. 2, the electronic device includes a hybrid connector jack assembly 32. While such a jack may be positioned on any surface, typically, an audio jack (and consequently, the hybrid connector jack assembly 32) is disposed on the top 28, bottom 30 or sides 24, 26. Most often, the same is positioned on the top 28. Of course, the position of the various components are merely for illustrative purposes as well, and not to be deemed limiting.

Figure 5:
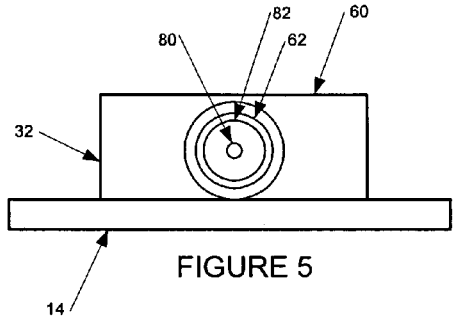
FIG. 5 of the drawings is a top plan view of the hybrid connector jack assembly coupled to the printed circuit board (PCB) shown in FIG. 3.
Figure 4:
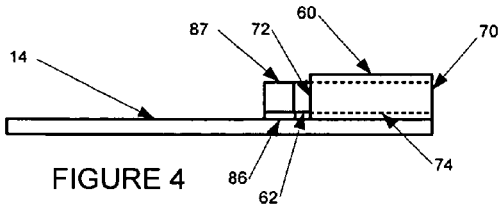
FIG. 4 of the drawings is a side elevational view of the printed circuit board (PCB) shown in FIG. 3.

The hybrid connector jack assembly is shown in FIGS. 3 through 5 as comprising audio jack component 60 and coaxial connector 62. The audio jack component 60 is configured to receive an audio connector, such as, for example, and without limitation, a TRS (tip, ring, sleeve) connector, a TS or TRRS connector. Generally, these are found in a 2.5 mm and a 3.5 mm size, although other sizes are likewise contemplated. Such audio jack component 60 includes a proximal end 70 and a distal end 72. An elongated slot 74 extends between these two ends. Between the proximal end and the distal end lie electrical leads and connectors which are configured to interface with the audio connector, providing audio to outside speakers or headsets and/or audio from a microphone.

Unlike a conventional audio jack, at the distal end 72 of the audio jack component 60, coaxial connector jack component 62 is positioned. The coaxial connector jack component 62 is visible from the proximal end 70 of the audio jack component 60 through the elongated opening 74. With particular reference to FIG. 5, the coaxial connector jack component includes central core conductor 80 and an outer shield conductor 82. With reference back to FIG. 4, in certain instances, a coaxial connector jack component 86 may be positioned on the PCB 14 (or flexible circuit) and extend outwardly therefrom. In such an instance, an elbow connector 87 may be provided to extend the coaxial connector jack component 86 to coaxial connector jack component 62 which is properly positioned at the distal end 72 of the audio jack 60.

In operation, and with reference to FIG. 3, a user can insert a audio connector 110 into the hybrid connector jack assembly 32 to receive audio transmitted therethrough, or to transmit audio therethrough from a microphone. For exemplary purposes only, the jack shown in FIG. 3 corresponds to a conventional TRS audio jack. To the user, there appears to be no difference between the hybrid connector jack and a conventional audio jack for the transmission of audio signals.

However, when the user removes the audio jack from the hybrid connector jack assembly, the coaxial connector jack component 62 becomes visible at the distal end 72 of the audio jack component. The coaxial connector jack component is accessible with the audio connector removed. The user can insert and connect to the coaxial connector jack component with a coaxial cable, such as coaxial cable 100 (which may comprise an RF connector cable). The coaxial cable 100 can be coupled to any number of outside devices. Such devices, for illustration purposes, and not to be deemed limiting, may correspond to a GPS unit, an external antenna, an Active GPS antenna, an emergency antenna, a hands free car kit, or a port for phasing a radio on the electronic device in the factory or in the field. Of course, any other device which utilizes a coaxial connector is contemplated for use.

Once use and need of the coaxial connector jack component is not required, the user can remove the coaxial cable 100 and the hybrid connector jack assembly is ready to accept an audio connector, again such as audio connector 110. It will be understood that a user can sequentially transfer between an audio connector and a coaxial connector.

Figure 6:
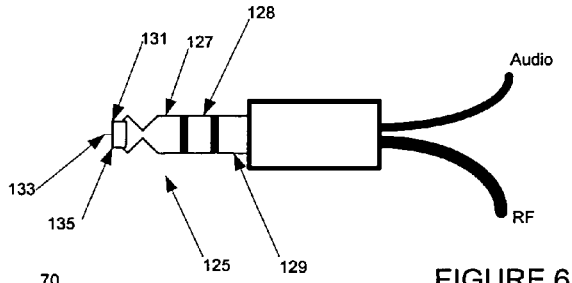
FIG. 6 of the drawings is a side elevational view of a combination connector which can be inserted into the hybrid connector jack assembly.

It is contemplated that a special hybrid connector, such as the connector shown in FIG. 6 can be deployed. The connector shown in FIG. 6 comprises a conventional TS, TRS or TRRS connector body 125. In this case, a TRS connector is shown with tip 127, ring 128 and sleeve 129. However, at the tip 127, a coaxial connector 131 having a central core conductor 133 and an outer shield conductor 135 is positioned. The coaxial connector 131 is insulated from the tip 127. Such a connector is configured to extend through the audio jack component 62 and into contact with the coaxial connector jack component 62. Thus, the tip 127, ring 128 and sleeve 129 are capable of electrically communicating with the audio jack component 62. At the same time, the coaxial connector 131 is capable of electrically communicating with the coaxial connector jack component 62. Such a hybrid jack can then be split into two separate cables, one directed to an audio device, and the other connected to a device which requires connection through a coaxial connector.

Advantageously, as electronic devices get smaller and smaller, and available space on the outer housing body becomes scarce, such a hybrid connector provides for both an audio jack and a coaxial connector through the same port. Thus, the amount of space available on the housing required for the two jacks is greatly reduced as together they require only the space conventionally allotted to an audio jack.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An electronic device comprising:

a body having a front, a back, a first side, a second side, a top and a bottom; and hybrid connector jack assembly accessible from the body, the hybrid connector jack assembly includes an audio jack component coupled to an electronic circuit, the audio jack component having a proximal end and a distal end, an elongated opening extends from the proximal end to the distal end and is structurally configured to receive a male audio connector; and a coaxial connector jack component positioned at the distal end of the audio jack component and accessible through the elongated opening of the audio jack component, to, in turn, allow for the insertion of a coaxial cable through the audio jack component and into operative engagement with the coaxial connector jack component;

wherein the electronic device comprises a mobile communication device, the hybrid connector jack assembly accessible from one of the first side, the second side, the top and the bottom of the body, and the body further comprising a keypad and a display screen.

2. The electronic device of claim 1 wherein the mobile communication device further includes a speaker and a microphone disposed on the body.

3. The electronic device of claim 1 wherein the hybrid connector jack assembly is accessible from the top of the body.

4. The hybrid connector jack assembly of claim 1 wherein the audio jack is one of the group consisting of: a TRS component jack, a TS component jack and a TRRS component jack.

5. The hybrid connector jack assembly of claim 1 wherein the audio jack comprises one of a 2.5 mm and a 3.5 mm jack.

6. The hybrid connector jack assembly of claim 1 wherein the coaxial connector jack component is configured for operative engagement with a coaxial cable coupled to one of the group consisting of: a GPS unit, an external antenna, an Active GPS antenna, an emergency antenna and a hands free car kit.

7. The hybrid connector jack assembly of claim 1 wherein the coaxial connector jack component includes a right angle adapter extending from the printed circuit board to an operable position at the distal end of the audio jack component.

* * * * *